US008736358B2

(12) United States Patent
Chen et al.

(10) Patent No.: US 8,736,358 B2
(45) Date of Patent: May 27, 2014

(54) CURRENT SOURCE WITH TUNABLE VOLTAGE-CURRENT COEFFICIENT

(75) Inventors: Chung-Kuang Chen, Pan Chiao (TW); Han-Sung Chen, Hsinchu (TW); Chun-Hsiung Hung, Hsinchu (JP)

(73) Assignee: Macronix International Co., Ltd., Hsinchu (TW)

( * ) Notice: Subject to any disclaimer, the term of this patent is extended or adjusted under 35 U.S.C. 154(b) by 167 days.

(21) Appl. No.: 12/840,943

(22) Filed: Jul. 21, 2010

(65) Prior Publication Data

US 2012/0019232 A1 Jan. 26, 2012

(51) Int. Cl.
*G05F 1/10* (2006.01)
*G05F 3/02* (2006.01)

(52) U.S. Cl.
USPC ..... 327/543

(58) Field of Classification Search
USPC ..... 327/538, 540, 541, 543; 323/315–316
See application file for complete search history.

(56) References Cited

U.S. PATENT DOCUMENTS

| | | | | |
|---|---|---|---|---|
| 6,091,287 | A | 7/2000 | Salter et al. | |
| 6,680,755 | B2 * | 1/2004 | Shen et al. | 348/674 |
| 6,741,118 | B2 * | 5/2004 | Uchikoba et al. | 327/541 |
| 7,417,415 | B2 * | 8/2008 | Yen et al. | 323/316 |
| 7,530,309 | B2 | 5/2009 | Schneider et al. | |
| 2002/0075067 | A1 * | 6/2002 | Kondo et al. | 327/541 |
| 2005/0099224 | A1 * | 5/2005 | Itoh | 327/541 |
| 2005/0184798 | A1 * | 8/2005 | Higemoto et al. | 327/543 |

* cited by examiner

*Primary Examiner* — Quan Tra
(74) *Attorney, Agent, or Firm* — McClure, Qualey & Rodack, LLP

(57) ABSTRACT

A current source providing an output current with a fixed current range includes a bias circuit, a resistor, a current mirror, and a controller. The bias circuit provides a first voltage weighted with a first tunable coefficient and a second voltage weighted with a second tunable coefficient. The resistor has a tunable resistance for determining a bias current according to a voltage difference between the first and the second voltages and the tunable resistance. The current mirror generates the output current according to the bias current. The controller adjusts the tunable resistance and one of the first and the second tunable coefficients to achieve a voltage-current coefficient with different values, while the bias current and the output current are kept within a fixed current range.

12 Claims, 4 Drawing Sheets

CURRENT SOURCE WITH TUNABLE VOLTAGE-CURRENT COEFFICIENT

BACKGROUND OF THE INVENTION

1. Field of the Invention

The invention relates in general to a current source, and more particularly to a current source having a voltage-current coefficient, which is defined by a difference of an output current per a supply voltage, with different values while the output current is kept within a fixed current range.

2. Description of the Related Art

In virtually all circuitry using integrated analog circuits, reference voltages or reference currents are required. Generally, reference currents are provided by current source, which is supposed to be constant under all operating conditions and should either have no temperature drift or a defined temperature drift coefficient. In some application, user has the inclination to have a current source a defined voltage-current coefficient, which is similarly defined as the temperature drift coefficient, with tunable delta current per delta voltage.

It is obvious that the operation of tuning the voltage-current coefficient can be achieved by tuning the equivalent resistance of the current source. However, the approach of directly tuning the equivalent resistance of the current source will also result in variation of DC current level, which is unwanted by the circuit user. Thus, how to provide a current source with tunable voltage-current coefficient while capable of keeping the DC current level within a fixed current range is a prominent object for the industries.

SUMMARY OF THE INVENTION

The invention is directed to a current source. In comparison to the conventional current source, the current source directed by the invention is advantageously capable of providing a tunable voltage-current coefficient while with the DC current level of its output current fixed within a fixed current range.

According to a first aspect of the present invention, a current source providing an output current with a fixed current range is provided. The current source comprises a bias circuit, a resistor, a current mirror, and a controller. The bias circuit provides a first voltage, which is weighted with a first tunable coefficient and providing a second voltage, which is weighted with a second tunable coefficient. The resistor has a tunable resistance for determining a bias current according to a voltage difference between the first and the second voltages and the tunable resistance. The current mirror generates the output current according to the bias current. The controller adjusts the tunable resistance and one of the first and the second tunable coefficients, so as to achieve a voltage-current coefficient, which is defined by a difference of the output current per the first voltage, with different values, while the bias current and the output current are kept within a fixed current range.

According to a second aspect of the present invention, a current source providing an output current with a fixed current range is provided. The current source comprises a bias means, a resistive means, an output means, and a control means. The bias means provides a first voltage, which is weighted with a first tunable coefficient and providing a second voltage, which is weighted with a second tunable coefficient. The resistive means has a tunable resistance for determining a bias current according to a voltage difference between the first and the second voltages and the tunable resistance. The output means generates the output current according to the bias current. The control means adjusts the tunable resistance and one of the first and the second tunable coefficients, so as to achieve a voltage-current coefficient, which is defined by a difference of the output current per the first voltage, with different values, while the bias current and the output current are kept within a fixed current range.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
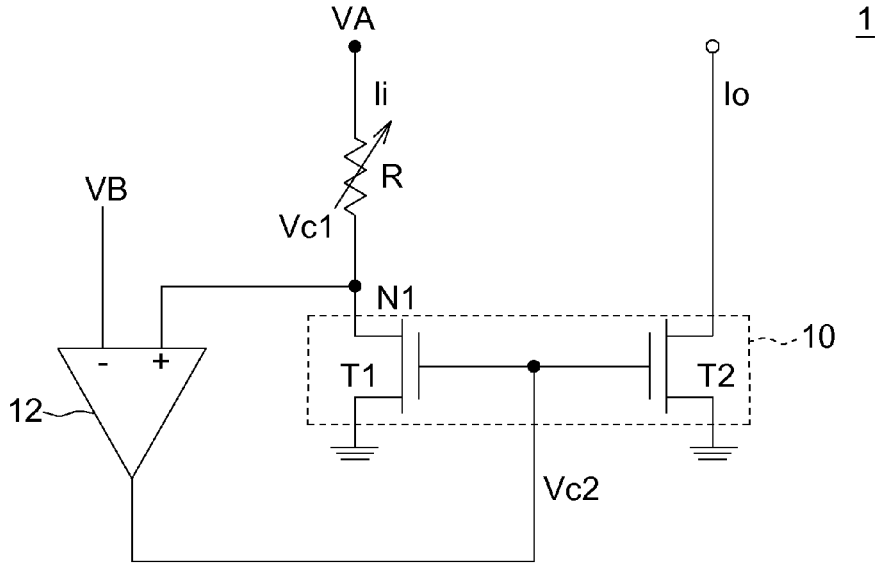
FIG. 1 is a circuit diagram of a current source related to an embodiment of the invention.

Referring to FIG. 1, a circuit diagram of a current source related to an embodiment of the invention is shown. The current source 1 includes a resistor R, a current mirror 10, a bias circuit 12, and a node N1. For example, the bias circuit 12 includes an operational amplifier for biasing the node N1 with a bias voltage, which has substantially the same voltage level as a reference voltage VB. The bias circuit 12 further provides a bias voltage Vc2 to the current mirror 10.

One end of resistor R is coupled to the node N1, and the other end receives a supply voltage VA. The resistor R, for example, has a tunable resistance Rx for determining a current signal Ii according to the supply voltage VA e.g. the VDD signal of the current source 1, the bias voltage Vc1, and the tunable resistance Rx. To be more specific, the current signal Ii satisfies:

$$I1 = \frac{(\mathrm{VA} - VB1)}{Rx}$$

The current mirror 10, which is employed as an output means of the current source 1 providing a current signal Io mirrored from the current signal Ii, includes transistors T1 and T2. For example, the transistors T1 and T2 are N type metal oxide semiconductors (NMOS). In response to the bias voltage Vc2 and the current signal Ii, the transistor T1 is biased in a linear region with a drain current of the current signal Ii. The transistor T2 is also biased by the bias voltage Vc2 and works as a current mapping device of the transistor T1, which works as the current host device, for providing a current signal Io mirrored from the current signal Ii. In an example, the channels of the transistors T1 and T2 are realized with substantially the same width/length ratios, so that the current signal Io provided by the transistor T2 is substantially the same as the current signal Ii.

In the present example, the current source 1 provides the current signal Io according to the supply voltage VA. In such a case, a voltage-current coefficient C, which is defined by a difference of the output current per the first voltage can be determined as:

$$C = \frac{\Delta I}{\Delta \mathrm{VA}} = \frac{1}{Rx}$$

$$Io = \frac{(\mathrm{VA} - Vc1)}{Rx}$$

As such, the voltage-current coefficient C of the current source 1 is substantially equal to the reciprocal of the resistance of the resistor R. Thus, operators of the current source 1 can effectively tune the voltage-current coefficient C for the current source 1 by means of tuning the resistance Rx of the resistor R. For example, as the resistance Rx is tuned to be 1 kilo-ohm (KΩ), the voltage-current coefficient C is accordingly tuned with a value of 1 milliampere per volts (mA/V); as the resistance Rx is tuned to be 0.2 KΩ, the voltage-current coefficient C corresponds with a value of 5 mA/V.

First Embodiment

Figure 2:
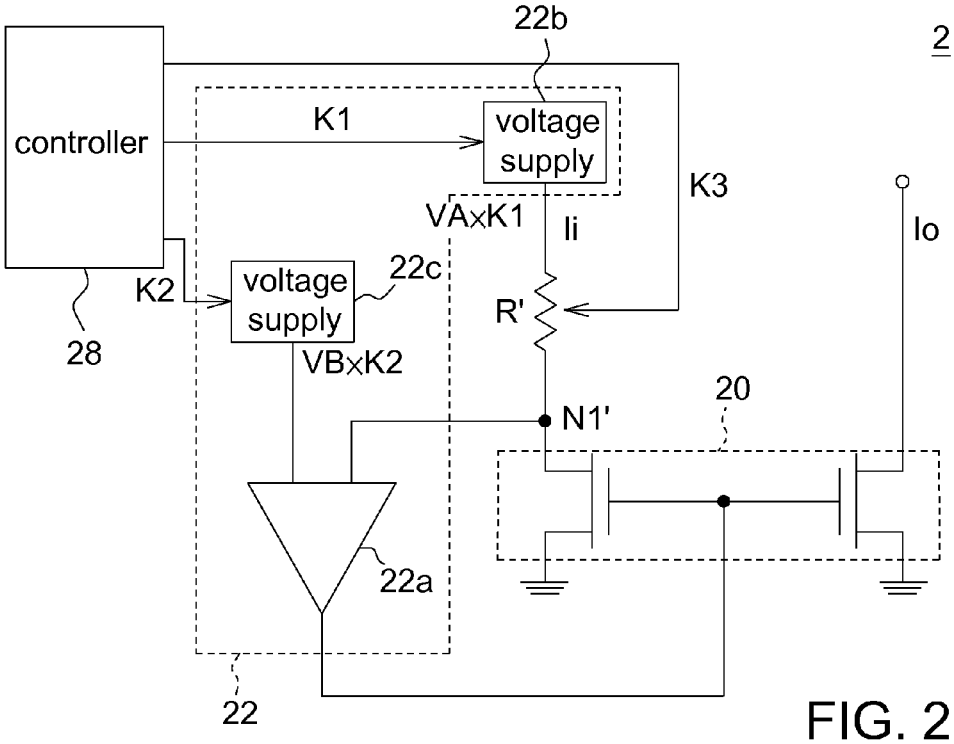
FIG. 2 is a circuit diagram of the current source according to a first embodiment of the invention.

Referring to FIG. 2, a circuit diagram of a current source according to the first embodiment of the invention is shown. The current source 2 is different from the current source 1 illustrated in FIG. 1 in that the bias circuit 22 further includes voltage supplies 22*b* and 22*c* for respectively providing a supply voltage VA×K1 and a reference voltage VB×K2, wherein the coefficients K1 and K2 are tunable real number greater than 0. The current source 2 further includes a controller 28, which selectively provides the coefficients K1 or K2 turning the output voltage of the voltage supplies 22*b* or 22*c* and provides a control signal K3 for tuning the resistance Rx' of the resistor R'.

Figure 3:
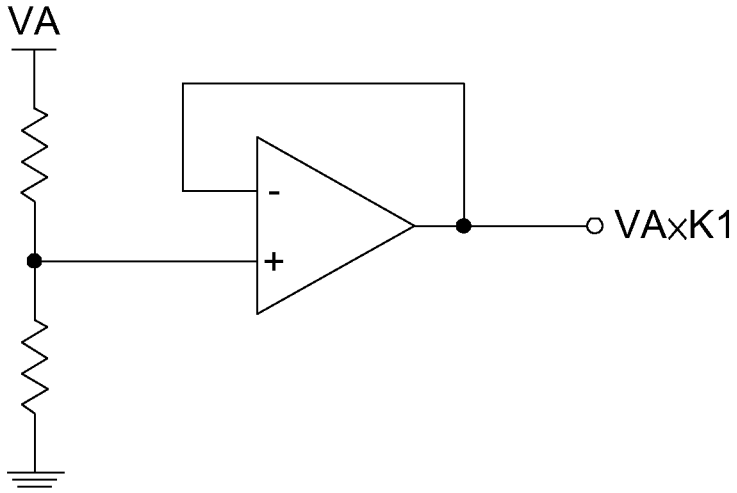
FIGS. 3 and 4 are circuit diagrams of the voltage supply 22*b* shown in FIG. 2.
Figure 4:
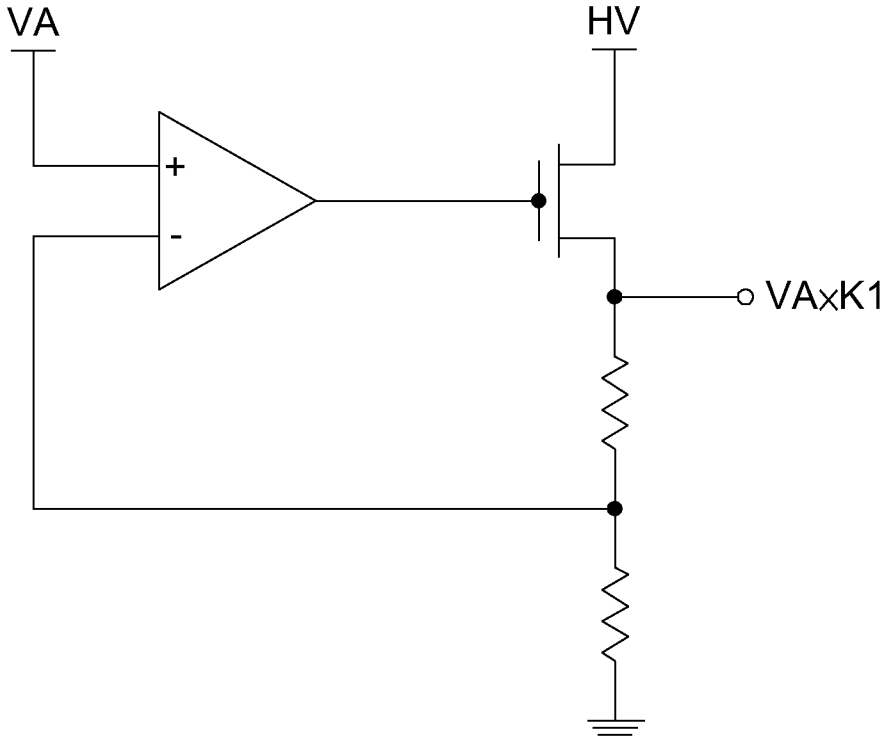
Figure 5:
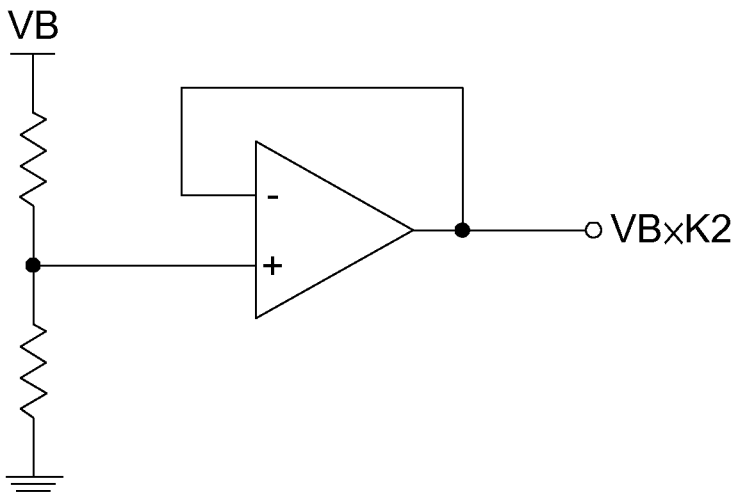
FIGS. 5 and 6 are circuit diagrams of the voltage supply 22*c* shown in FIG. 2.
Figure 6:
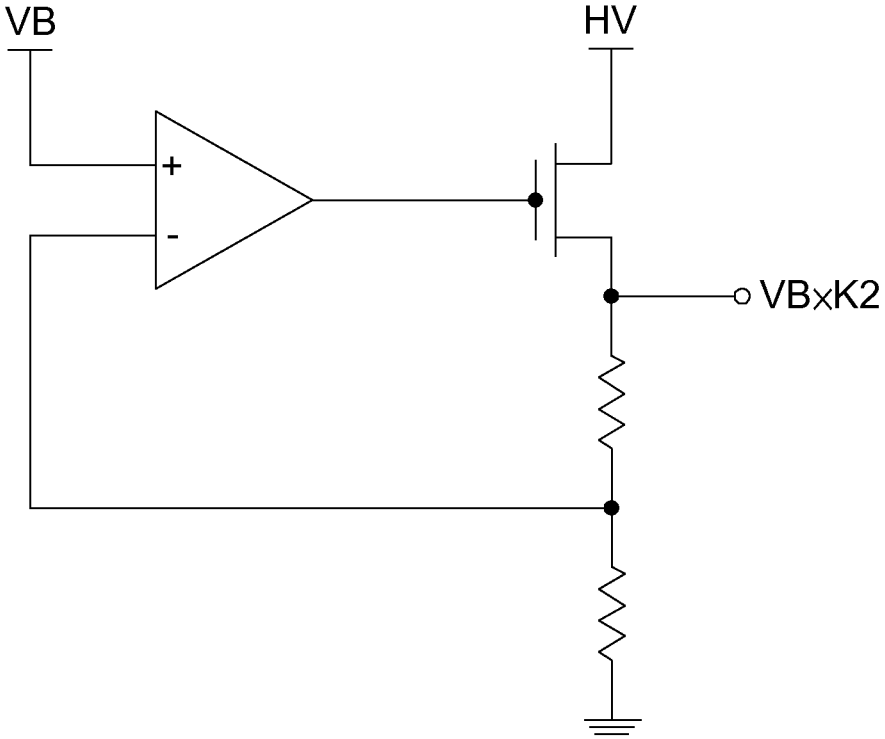

In an example, the voltage supply 22*b* includes a voltage supply unit with a circuit structure illustrated in FIG. 3 or FIG. 4 for providing the supply voltage VA×K1 while the coefficient K1 is smaller than 1 and providing the supply voltage VA×K1 while the coefficient K1 is greater than 1, respectively. In other example, the voltage supply 22*b* may also includes both the supply units illustrated in FIG. 3 and FIG. 4 to provide the supply voltage VA×K1 while the coefficient K1 is smaller than 1 and greater than 1. Similarly to the voltage supply 22*b*, the voltage supply 22*c* may also includes a voltage supply unit illustrated in FIG. 5, a voltage supply unit illustrated in FIG. 6 or voltage supply units illustrated in both FIGS. 5 and 6.

In the present example, the voltage-current coefficient C of the current source 2 can be determined as:

$$Io1 = (K1 \times \mathrm{VA1} - K2 \times VB)/Rx'$$

$$Io2 = (K1 \times \mathrm{VA2} - K2 \times VB)/Rx'$$

$$\Delta Io = Io2 - Io1 = K1 \times (\mathrm{VA1} - \mathrm{VA2})/R$$

$$C = \frac{\Delta I}{\Delta \mathrm{VA}} = \frac{K1 \times (\mathrm{VA1} - \mathrm{VA2})/R}{\mathrm{VA1} - \mathrm{VA2}} = \frac{K1}{Rx'}$$

$$Io = \frac{(K1 \times \mathrm{VA} - K2 \times VB)}{Rx'}$$

Wherein, VA1 and VA2 represent the different values of the supply voltage VA; Io1 and Io2 represent the different values of the current signal Io when the supply voltage VA corresponds to the value of VA1 and VA2, respectively.

As such, the voltage-current coefficient C of the current source 2 is substantially equal to the quotient of the coefficient K1 and the resistance Rx' of the resistor R'. Thus, by altering the resistance Rx' of the resistor R' and the coefficient K1 through the controller 28, operators of the current source 2 can effectively tune the voltage-current coefficient C.

Besides, the magnitude of the current signal Io is further related to the coefficients K1 and K2. Thus, by tuning the coefficients K1, K2 and K3 (i.e. the resistance Rx' of the resistor R') altogether, the operators of the current source 2 can easily found an optimum setting of the coefficients K1-K3 where the voltage-current coefficient C may be tuned with different values while the current signal Io are kept within a fixed current range.

Second Embodiment

Figure 7:
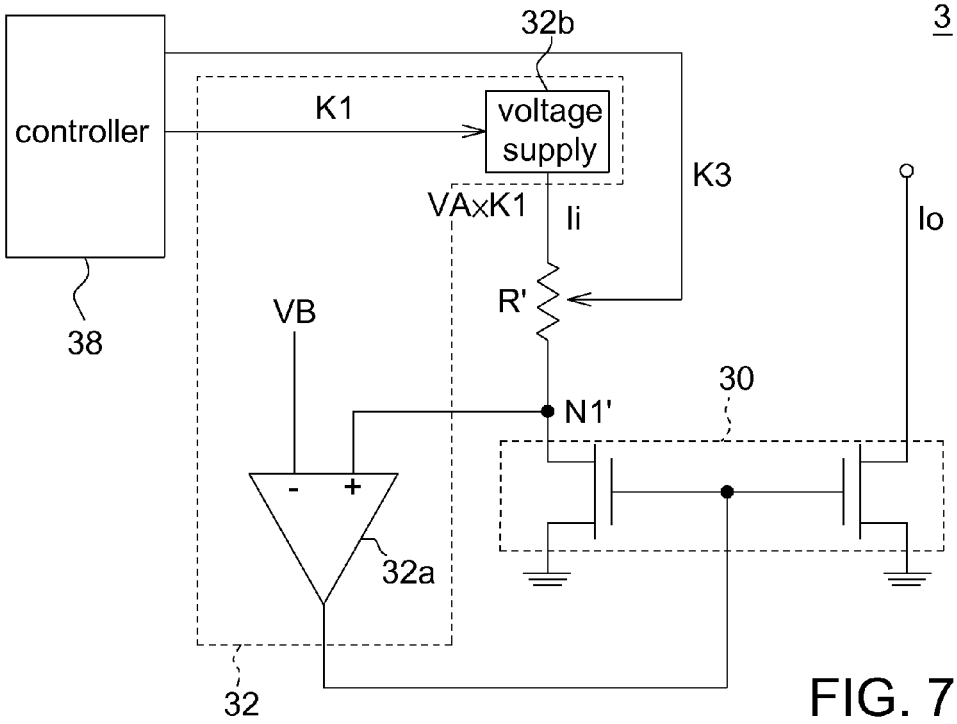
FIG. 7 is a circuit diagram of the current source according to a second embodiment of the invention.

Referring to FIG. 7, a circuit diagram of a current source according to the second embodiment of the invention is shown. The current source 3 is different from the current source 2 illustrated in FIG. 2 in that the voltage supply for providing the reference voltage VB×K2 is omitted and only the voltage supply 32*b* is provided to provide the supply voltage VA×K1. Thus, by tuning the coefficients K1 and K3 (i.e. the resistance Rx' of the resistor R') altogether, the operators of the current source 3 can also easily found an optimum setting of the coefficients K1 and K3 where the voltage-current coefficient C may be tuned with different values while the current signal Io are kept within a fixed current range.

Third Embodiment

Figure 8:
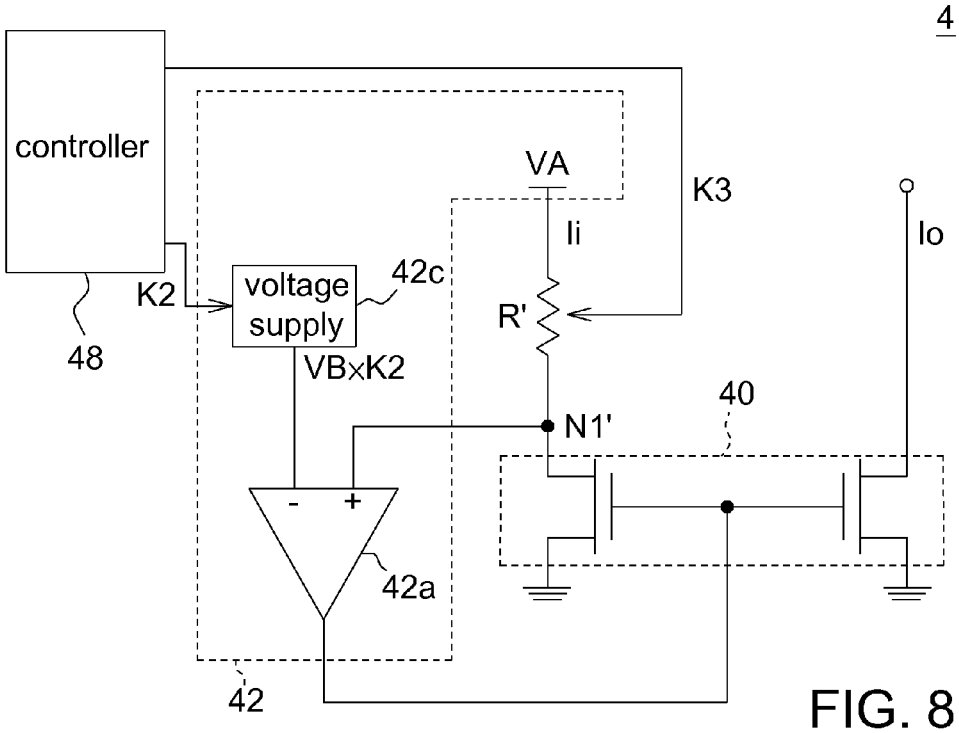
FIG. 8 is a circuit diagram of the current source according to a third embodiment of the invention.

Referring to FIG. 8, a circuit diagram of a current source according to the third embodiment of the invention is shown. The current source 4 is different from the current source 2 illustrated in FIG. 2 in that the voltage supply for providing the supply voltage VA×K1 is omitted and only the voltage supply 42*c* is provided to provide the reference voltage VB×K2. Thus, by tuning the coefficients K2 and K3 (i.e. the resistance Rx' of the resistor R') altogether, the operators of the current source 4 can also easily found an optimum setting of the coefficients K2 and K3 where the voltage-current coefficient C may be tuned with different values while the current signal Io are kept within a fixed current range.

The current source according to the embodiments of the invention applies a bias circuit capable of providing first voltage weighted by first coefficient or second voltage weighted by second coefficient and a resistor with variable resistance. The current source according to the present embodiment of the invention further applies a controller to alter the first coefficient and the variable resistance or alter the second coefficient and the variable resistance, so as to provide the current source according to the present embodiment with a tunable voltage-current coefficient while keep the DC output current level of the current source within a fixed current range. As such, in comparison to the conventional current source, the current source according to the present embodiment is advantageously capable of providing a tunable voltage-current coefficient while with the DC current level of its output current fixed within a fixed current range.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A current source providing an output current with a fixed current range, the current source comprising:

a bias circuit, for providing a first voltage, which is weighted with a first tunable coefficient and providing a second voltage, which is weighted with a second tunable coefficient;

a resistor, having a tunable resistance, the resistor determining a bias current according to a voltage difference between the first and the second voltages;

a current mirror, for generating the output current according to the bias current; and a controller, for achieving a voltage-current coefficient, which is defined by a difference of the output current per the first voltage, the controller further selectively having the voltage-current coefficient configured with different values by means of adjusting the tunable resistance and one of the first tunable coefficient and the second tunable coefficient, and keeping the bias current and the output current within a fixed current range;

wherein the bias circuit further comprises:

a first node and a second node, wherein one of the first voltage and the second voltage is provided on the second node and is directly connected to the resistor;

an operational amplifier, having a first input end and a second input end respectively receiving a first reference voltage and coupled to the first node, and having an output node;

a transistor, having a first terminal and a second terminal respectively receiving a second reference voltage and coupled to the second node, and having a control terminal coupled to the output node;

a first resistor, coupled between the first and the second node; and a second resistor, having a first terminal and a second terminal respectively coupled to the first node and receiving a ground reference.

2. The current source according to claim 1, wherein the first and the second tunable coefficients are respectively assigned as value K1 and value 1 and the voltage-current coefficient is determined as:

$$I1 = (K1 \times \mathrm{VA1} - VB)/R$$

$$I2 = (K1 \times \mathrm{VA2} - VB)/R$$

$$\Delta I = I2 - I1 = K1 \times (\mathrm{VA1} - \mathrm{VA2})/R$$

$$C = \frac{\Delta I}{\Delta \mathrm{VA}} = \frac{K1 \times (\mathrm{VA1} - \mathrm{VA2})/R}{\mathrm{VA1} - \mathrm{VA2}} = \frac{K1}{R}$$

$$Io = (K1 \times \mathrm{VA} - VB)/R$$

wherein,

VA is the first voltage; VB is the second voltage; R is the tunable resistance; Io is the output current; C is the voltage-current coefficient; and the controller tunes the voltage-current coefficient while keeps the bias current and the output current within the fixed range by means of tuning the first tunable coefficient K1 and the tunable resistance R.

3. The current source according to claim 1, wherein the first and the second tunable coefficients are respectively assigned as value 1 and value K2 and the voltage-current coefficient is determined as:

$$I1 = (\mathrm{VA1} - K2 \times VB)/R$$

$$I2 = (\mathrm{VA2} - K2 \times VB)/R$$

$$\Delta I = I2 - I1 = (\mathrm{VA1} - \mathrm{VA2})/R$$

$$C = \frac{\Delta I}{\Delta \mathrm{VA}} = \frac{(\mathrm{VA1} - \mathrm{VA2})/R}{\mathrm{VA1} - \mathrm{VA2}} = \frac{1}{R}$$

$$Io = (\mathrm{VA} - K2 \times VB)/R$$

wherein,

VA is the first voltage; VB is the second voltage; R is the tunable resistance; Io is the output current; C is the voltage-current coefficient; and the controller tunes the voltage-current coefficient while keeps the bias current and the output current within the fixed range by means of tuning the second tunable coefficient K2 and the tunable resistance R.

4. The current source according to claim 1, wherein the first and the second tunable coefficients are respectively assigned as value K1 and value K2 and the voltage-current coefficient is determined as:

$$I1 = (K1 \times \mathrm{VA1} - K2 \times VB)/R$$

$$I2 = (K1 \times \mathrm{VA2} - K2 \times VB)/R$$

$$\Delta I = I2 - I1 = K1 \times (\mathrm{VA1} - \mathrm{VA2})/R$$

$$C = \frac{\Delta I}{\Delta \mathrm{VA}} = \frac{K1 \times (\mathrm{VA1} - \mathrm{VA2})/R}{\mathrm{VA1} - \mathrm{VA2}} = \frac{K1}{R}$$

$$Io = (K1 \times \mathrm{VA} - K2 \times VB)/R$$

wherein,

VA is the first voltage; VB is the second voltage; R is the tunable resistance; Io is the output current; C is the voltage-current coefficient; and the controller tunes the voltage-current coefficient while keeps the bias current and the output current within the fixed range by means of tuning the first tunable coefficient K1, the second tunable coefficient K2 and the tunable resistance R.

5. A current source providing an output current with a fixed current range, the current source comprising:

a bias means for providing a first voltage, and a second voltage;

a resistive means, having a tunable resistance for determining a bias current according to a voltage difference between the first and the second voltages;

an output means, for generating the output current according to the bias current; and a control means, for achieving a voltage-current coefficient, which is defined by a difference of the output current per the first voltage, the controller further selectively having the voltage-current coefficient configured with different values by means of adjusting the tunable resistance and one of the first voltage and the second voltage, and keeping the bias current and the output current within a fixed current range;

wherein the bias means further comprises:

a first node and a second node, wherein one of the first voltage and the second voltage is provided on the second node and is directly connected to the resistive means;

an operational amplifier, having a first input end and a second input end respectively receiving a first reference voltage and coupled to the first node, and having an output node;

a transistor, having a first terminal and a second terminal respectively receiving a second reference voltage and coupled to the second node, and having a control terminal coupled to the output node;

a first resistor, coupled between the first and the second node; and a second resistor, having a first terminal and a second terminal respectively coupled to the first node and receiving a ground reference.

6. The current source according to claim 5, wherein the first voltage is varied with a first tunable coefficient provided by the control means, and the second voltage is varied with a second tunable coefficient provided by the control means, the first and the second tunable coefficients are respectively assigned as value K1 and value 1, and the voltage-current coefficient is determined as:

$$I1 = (K1 \times \mathrm{VA1} - VB)/R$$

$$I2 = (K1 \times \mathrm{VA2} - VB)/R$$

$$\Delta I = I2 - I1 = K1 \times (\mathrm{VA1} - \mathrm{VA2})/R$$

$$C = \frac{\Delta I}{\Delta \mathrm{VA}} = \frac{K1 \times (\mathrm{VA1} - \mathrm{VA2})/R}{\mathrm{VA1} - \mathrm{VA2}} = \frac{K1}{R}$$

$$Io = (K1 \times \mathrm{VA} - VB)/R$$

wherein,

VA is the first voltage; VB is the second voltage; R is the tunable resistance; Io is the output current; C is the voltage-current coefficient; and the control means tunes the voltage-current coefficient while keeps the bias current and the output current within the fixed range by means of tuning the first tunable coefficient K1 and the tunable resistance R.

7. The current source according to claim 6, wherein the first and the second tunable coefficients are respectively assigned as value 1 and value K2 and the voltage-current coefficient is determined as:

$$I1 = (\mathrm{VA1} - K2 \times VB)/R$$

-continued $$I2 = (\mathrm{VA2} - K2 \times VB)/R$$

$$\Delta I = I2 - I1 = (\mathrm{VA1} - \mathrm{VA2})/R$$

$$C = \frac{\Delta I}{\Delta \mathrm{VA}} = \frac{(\mathrm{VA1} - \mathrm{VA2})/R}{\mathrm{VA1} - \mathrm{VA2}} = \frac{1}{R}$$

$$Io = (\mathrm{VA} - K2 \times VB)/R$$

wherein,

VA is the first voltage; VB is the second voltage; R is the tunable resistance; Io is the output current; C is the voltage-current coefficient; and the control means tunes the voltage-current coefficient while keeps the bias current and the output current within the fixed range by means of tuning the second tunable coefficient K2 and the tunable resistance R.

8. The current source according to claim 6, wherein the first and the second tunable coefficients are respectively assigned as value K1 and value K2 and the voltage-current coefficient is determined as:

$$I1 = (K1 \times \mathrm{VA1} - K2 \times VB)/R$$

$$I2 = (K1 \times \mathrm{VA2} - K2 \times VB)/R$$

$$\Delta I = I2 - I1 = K1 \times (\mathrm{VA1} - \mathrm{VA2})/R$$

$$C = \frac{\Delta I}{\Delta \mathrm{VA}} = \frac{K1 \times (\mathrm{VA1} - \mathrm{VA2})/R}{\mathrm{VA1} - \mathrm{VA2}} = \frac{K1}{R}$$

$$Io = (K1 \times \mathrm{VA} - K2 \times VB)/R$$

wherein,

VA is the first voltage; VB is the second voltage; R is the tunable resistance; Io is the output current; C is the voltage-current coefficient; and the control means tunes the voltage-current coefficient while keeps the bias current and the output current within the fixed range by means of tuning the first tunable coefficient K1, the second tunable coefficient K2 and the tunable resistance R.

9. The current source according to claim 1, wherein the first voltage is provided on the second node.

10. The current source according to claim 1, wherein the second voltage is provided on the second node.

11. The current source according to claim 5, wherein the first voltage is provided on the second node.

12. The current source according to claim 5, wherein the second voltage is provided on the second node.

* * * * *